US005618019A

United States Patent [19]

Wren

[11] Patent Number: 5,618,019

[45] Date of Patent: Apr. 8, 1997

[54] BUMPER INSTALLATION FOR SENSOR GATE

[76] Inventor: Clifford T. Wren, 2036 Honeysuckle La., Jefferson City, Mo. 65109

[21] Appl. No.: 476,612

[22] Filed: Jun. 7, 1995

[51] Int. Cl.[6] ..... A47B 95/00

[52] U.S. Cl. ..... 248/345.1

[58] Field of Search ..... 248/345.1; 206/587, 206/588, 591

[56] References Cited

U.S. PATENT DOCUMENTS

| | | | |
|---|---|---|---|
| 3,884,495 | 5/1975 | Petock | 248/345.1 X |
| 4,089,497 | 5/1978 | Miller et al. | 248/345.1 |
| 4,554,039 | 11/1985 | James | 156/213 |
| 4,925,149 | 5/1990 | DiFrancesca et al. | 248/345.1 X |
| 5,163,197 | 11/1992 | Armstrong et al. | 5/663 |
| 5,331,696 | 7/1994 | Armstrong et al. | 5/663 X |
| 5,369,925 | 12/1994 | Vargo | 248/345.1 X |

FOREIGN PATENT DOCUMENTS 984651 3/1965 United Kingdom .

*Primary Examiner*—Ramon O. Ramirez
*Attorney, Agent, or Firm*—Howell & Haferkamp, L.C.

[57] ABSTRACT

A bumper installation for a sensor gate that detects and prevents shoplifting includes a cushion adhered to an interior side of a rigid casing. The cushion has a cavity formed therein which has a shape complementary to an external configuration of the sensor gate. Once installed on the sensor gate, the bumper installation deflects and absorbs the impact of objects colliding with the bumper, thereby protecting the sensor gate from damage and preventing the impacting objects from adversely effecting the calibration of the sensor gate.

19 Claims, 3 Drawing Sheets

BUMPER INSTALLATION FOR SENSOR GATE

BACKGROUND OF THE INVENTION

1. Field of the Invention

The present invention pertains to a bumper installation for protecting sensor gates, such as those utilized to prevent shoplifting, from impacting objects that can damage the sensor gates and/or adversely effect their calibration.

2. Description of the Related Art

Sensor gates are currently in widespread use in retail and other types of stores for detecting and preventing shoplifting. These gates are normally positioned at the exits of the store and are utilized in conjunction with detection tags which are attached to retail items and are removed at a checkout station with a special tool or apparatus. However, if a shoplifter attempts to steal a retail item having a detection tag attached thereto, or if a shopper inadvertently attempts to leave the retail store without paying for the retail item and having the detection tag removed, the detection tag will be detected by the sensor gate as the retail item passes through the sensor gate with the detection tag attached thereto. At that time, an alarm or some other type of indicator will be activated so that the shoplifter, or inattentive shopper, can be detected and prevented from leaving the store without paying for the retail item.

Because sensor gates are ordinarily positioned at the exit areas of retail stores, which experience the greatest amount of pedestrian traffic, the sensor gates are subject to being bumped or impacted by a wide variety of objects, including shopping carts, shopping bags, wheelchairs, dollies, and people, including children. Of course, the collision of these objects or persons with the sensor gates can result in damage to the sensor gates, and commonly results in a degradation of the calibration of sensitive electronic equipment contained within the sensor gate.

Once the calibration of the sensor gate has been adversely affected, the sensor gate may indicate that a customer exiting through the gate is attempting to shoplift a retail item when in fact, no attempted theft has occurred. This can result in substantial embarrassment for the customer, as well as substantial ill will for the retail store. On the other hand, the calibration of the sensor gate could be adversely effected by an impacting object such that the sensor gate does not detect the passing of a detection tag through the sensor gate as a shoplifter leaves the store without paying for the retail item to which the detection tag is attached. This poses an equally serious, if not more serious, problem for the retail establishment.

What is needed is a device for sheltering and protecting the sensor gate from the impact of objects and persons which inevitably results in high traffic areas. Preferably, such a device would be relatively inexpensive to manufacture, relatively easy to install, and extremely effective at protecting the sensor gate and maintaining the calibration of sensitive electronic equipment contained therein.

SUMMARY OF THE INVENTION

The present invention solves these and other problems by providing a bumper installation for a sensor gate which can be easily manufactured from inexpensive materials, and which can be easily installed to provide a high degree of impact protection to the sensor gate. One of the key attributes of the invention is its simplicity. The bumper installation includes a rigid casing which is constructed from a material having a high impact strength and durability and which surrounds a cushion having a cavity formed therethrough. The cushion is constructed of a material capable of absorbing impact forces, and is protected from damage by the rigid casing. The cushion cavity is configured to correspond to an external size and shape of the sensor gate on which the bumper installation will be mounted.

The bumper installation can be easily mounted on a sensor gate by simply sliding the bumper installation over the top of the sensor gate with the sensor gate positioned within the cavity in the cushion. In this manner, the bumper installation completely surrounds the sensor gate and protects all sides of the sensor gate from impacting objects.

The bumper installation of the present invention can be easily manufactured by securing several sections of a cushion material to a single sheet of ABS plastic. The plastic can then be heated along fold lines, which correspond to the ends of two outer cushion sections attached thereto, and then bent along those fold lines to form the bumper installation into a generally rectangular configuration. Thereafter, a second sheet of ABS plastic can be adhered to an interior side of the rigid casing where opposite ends of the single sheet of ABS plastic abut. An additional section of a cushion material can then be secured to the second sheet of plastic to provide a continuous cushion on the interior surface of the casing which completely defines and surrounds the cushion cavity.

Where the sensor gate sought to be protected from impact includes a protruding base member at its bottom, the bumper installation can be fabricated such that its casing extends below a bottom surface of the cushion providing room below the cushion to accommodate the protruding base of the sensor gate.

While the principal advantages and features of the invention have been described above, a greater understanding of the invention may be attained by referring to the drawings and the description of the preferred embodiment which follow.

DETAILED DESCRIPTION OF THE PREFERRED EMBODIMENT

Figure 1:
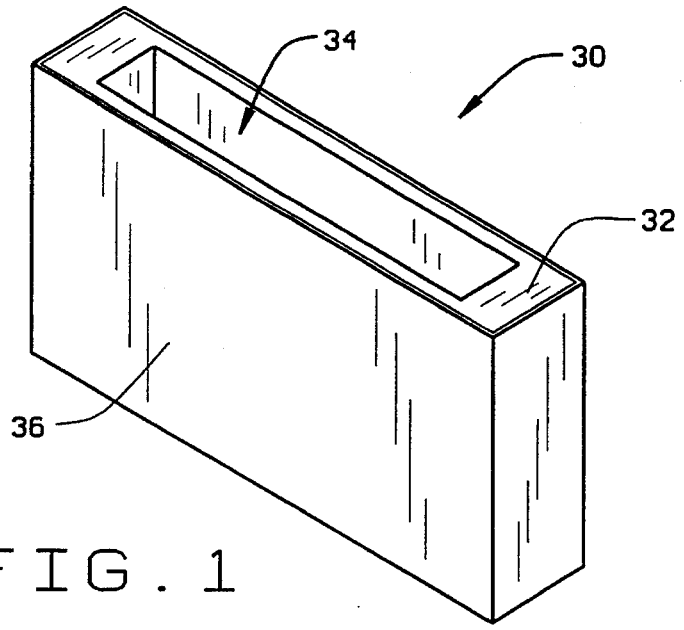
FIGS. 1 is an isometric view of a bumper installation according to the present invention.

A bumper installation 30 for a sensor gate which has been constructed in accordance with the present invention is shown in FIG. 1. The bumper installation is generally comprised of a cushion 32 that has a cavity 34 formed therein. In the preferred embodiment, the cushion is constructed from a polyester foam material that is capable of absorbing and attenuating the force of impacting objects, thereby protecting the sensor gate from these impact forces when the bumper installation is properly mounted thereon. However, other materials can be utilized to construct the cushion 32 which have similar impact absorbing qualities.

The cavity 34 has a configuration that is complementary to an external configuration of the sensor gate (shown in FIGS. 7 and 8) so that the bumper installation 30 can be mounted on the sensor gate with the sensor gate positioned within the cavity 34. Thus, although the cavity is illustrated as having a generally rectangular configuration to correspond to the generally rectangular external configuration of the sensor gate shown in FIGS. 7 and 8, other configurations of the cavity can be utilized for different external configurations of the sensor gate. When the bumper installation 30 is mounted on the sensor gate, the cushion 32 absorbs the impact of objects or persons that would impact the sensor gate in the absence of the bumper installation, and that could adversely effect the sensor gate calibration or otherwise result in damage to the sensor gate. Thus, the bumper installation 30 of the present invention can be utilized to protect a sensor gate, and serves to maintain the calibration of the sensitive equipment contained within, or connected to, the sensor gate.

As can be seen in FIG. 1, the cushion 32 completely surrounds the cavity 34 so that the bumper installation 30 will extend around the entirety of the sensor gate when mounted thereon, and as a result, protects the sensor gate from impacting objects on all sides of the sensor gate. Alternatively, the bumper installation 30 can be constructed so that the cushion extends around less than all sides of the sensor gate, such as only the sides of the sensor gate that face high traffic areas, and hence, are most prone to impact by persons and objects.

The bumper installation 30 of the preferred embodiment is also provided with a rigid casing 36 that surrounds the cushion 32, and to which the cushion 32 is adhered. The casing 36 serves to distribute the forces of objects impacting the bumper installation 30 over a greater area of the cushion 32 than if the casing 36 was not utilized. Hence, the casing 36 further protects the sensor gate and its calibration, and prevents the polyester foam cushion 32 from being crushed, torn or otherwise damaged by a colliding object. In the alternate embodiment where the cushion 32 extends around less than all sides of the sensor gate, the casing 36 would still be utilized to protect the exterior sides of the cushion 32, but would not completely surround the cushion 32 as it does in the preferred embodiment.

The casing 36 is preferably constructed from an ABS plastic. ABS plastics are formed from three monomers: acrylonitrile; styrene; and butadiene. Acrylonitrile provides high strength to the resulting plastic as well as heat and chemical resistance. Styrene provides a gloss and processability, and contributes to the plastic's rigidity. Butadiene contributes to the impact strength and toughness of the plastic, in addition to providing a low temperature property retention. Thus, it is believed that an ABS plastic is the most suitable material for the rigid casing 36 so that the casing has a high impact strength and durability, as well as a low manufacturing cost. However, other types of plastics and materials could also be used which can be constructed into the desired configuration of the casing 36 and can protect the cushion 32 from being crushed, torn or otherwise damaged by a colliding object.

Figure 2:
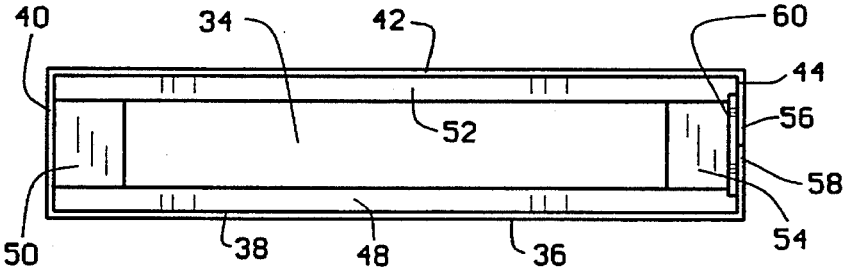
FIG. 2 is a plan view of the bumper installation of FIG. 1.

As shown in FIG. 2, the casing 36 includes a plurality of interconnected surfaces 38, 40, 42, and 44 to which a plurality of cushion sections 48, 50, 52, and 54 are adhered, respectively. As shown therein, each cushion section contacts two adjacent cushion sections such that the plurality of cushion sections 48, 50, 52, and 54 completely surround the cavity 34 so that the bumper installation 30 extends around the entirety of the sensor gate when mounted thereon.

In the preferred embodiment, the casing 36 is formed from a single sheet of ABS plastic, and as a result, has opposite ends 56, 58 which abut to form casing surface 44. A second sheet of material 60, which is also formed from an ABS plastic in the preferred embodiment, is adhered to a backside of the opposite abutting ends 56, 58 to hold the ends together and form a part of the casing surface 44. Cushion section 54 is adhered directly to the second sheet of ABS plastic 60.

Figure 3:
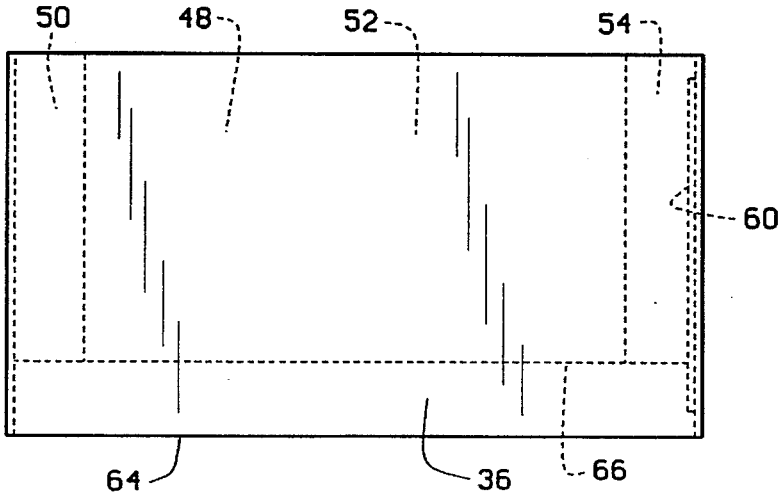
FIG. 3 is a front elevation view of the bumper installation.
Figure 4:
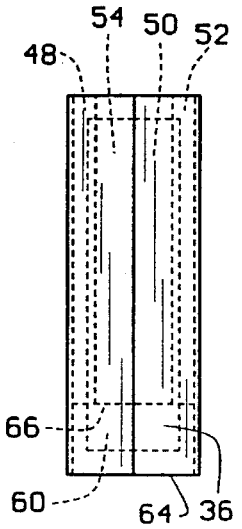
FIG. 4 is a side elevation view of the bumper installation.

As can be seen in FIGS. 3 and 4, a bottom edge 64 of the casing 36 extends below the bottom surface 66 of the cushion 32. The bumper installation 30 is configured in this manner to accommodate a protruding base member 102 of the sensor gate 100 shown in FIGS. 7 and 8. As a result, when the bumper installation 30 is mounted on the sensor gate 100, the bottom edge 64 of the casing 36 contacts a floor surface while the bottom surface 66 of the cushion 32 contacts a top surface of the sensor gate's protruding base member 102. For sensor gates which do not have protruding base members, the bumper installation 30 can be constructed with the plurality of cushion sections extending such that the bottom surface 66 of the cushion 32 is flush with the bottom edge 64 of casing 36.

Figure 8:
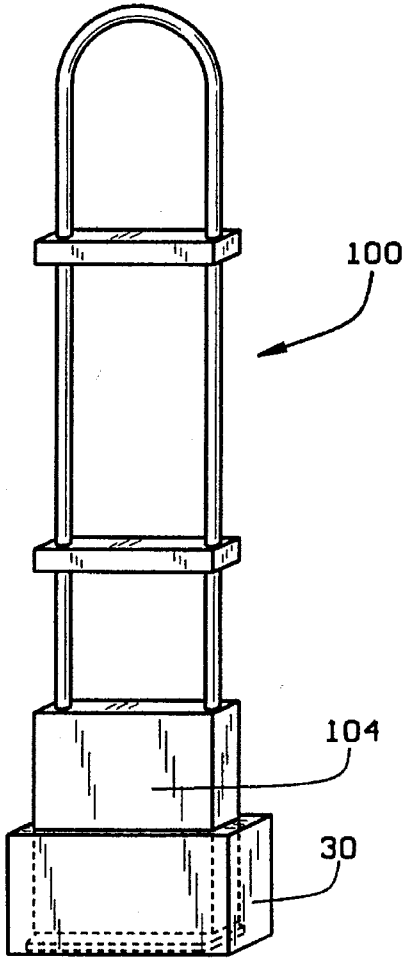
FIG. 8 is a perspective view of the bumper installation after it has been mounted on the sensor gate.
Figure 7:
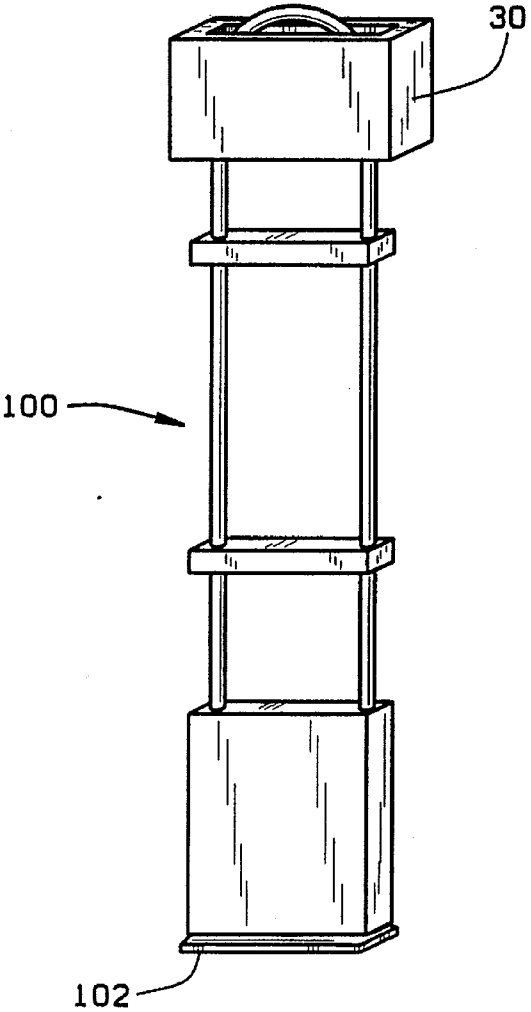
FIG. 7 is a perspective view of the bumper installation as it is being mounted on a sensor gate.

As also can be seen in the drawing figures, the external configuration of the bumper installation 30 of the preferred embodiment is generally rectangular. This configuration is utilized for several reasons. First, a rectangular configuration provides for a simple manufacture, especially where the configuration of the cushion cavity 34 is generally rectangular. As a result, the bumper installation 30 of the preferred embodiment can be manufactured for a relatively low cost. Second, the external configuration of the sensor gate shown in FIGS. 7 and 8 is also generally rectangular. Because the bumper installation 30 of the preferred embodiment does not completely cover the body 104 of the sensor gate 100, it is believed that an external configuration of the bumper installation 30 that corresponds to the external configuration of the sensor gate is the most aesthetically pleasing. However, if the cost of manufacturing the bumper installation is not a concern, or if the external configuration of the sensor gate is other than rectangular, or if the bumper installation is constructed to completely conceal the body 104 of the sensor gate, or if a rectangular external configuration is otherwise undesirable for the bumper installation 30, then other configurations can be utilized with similar effect.

Figure 5:
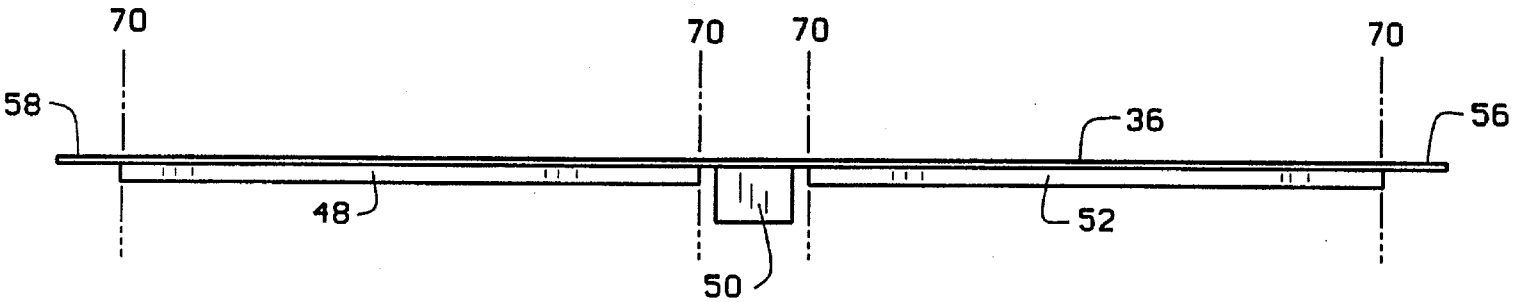
FIG. 5 is a plan view of a portion of the bumper installation during its construction.
Figure 6:
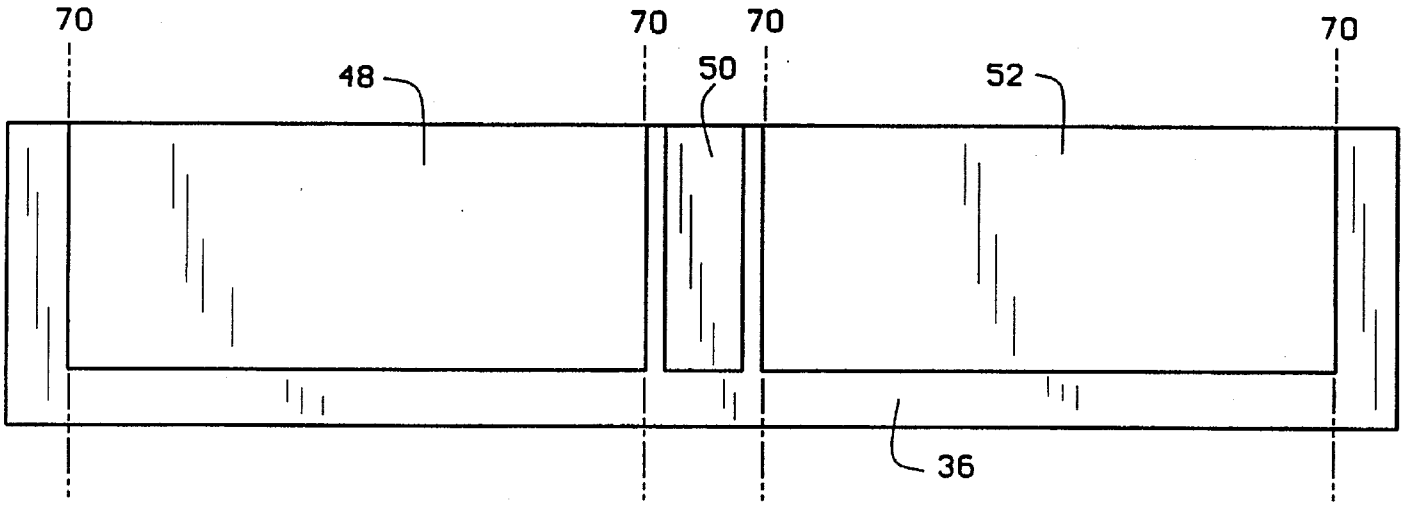
FIG. 6 is a front elevation view of the portion of the installation bumper shown in FIG. 5.

To construct the bumper installation of the present invention, several cushion sections are attached to a single sheet of ABS plastic "on the flat." In other words, several of the cushion sections 48, 50, and 52 are adhered to the single sheet of ABS plastic, as shown in FIGS. 5 and 6, before the casing 36 is formed into its rectangular configuration shown in FIGS. 1–4. Thereafter, the single sheet of plastic is heated along several fold lines 70 to soften the plastic. The fold lines 70 correspond to the ends of the two outer cushion sections 48 and 52. After the fold lines are heated and softened, the sheet is bent along the fold lines 70 to form the casing 36 having a rectangular configuration.

Note that before the casing 36 is formed from the single sheet of plastic, the cushion sections 48, 50, and 52 are spaced apart so that cushion section 50 contacts cushion sections 48 and 52 after the casing 36 has been formed into its configuration shown in FIG. 2. After the casing 36 has been formed, the second sheet of ABS plastic 60 can be adhered to an interior side of the opposite abutting ends 56 and 58. The remaining cushion section 54 can then be adhered to the second sheet of ABS plastic 60 to complete the construction of the bumper installation 30. Note also that prior to the cushion sections 48, 50, 52, and 54 being adhered to the casing 36, these cushion sections are sized such that the bottom edge 64 of casing 36 will extend below their bottommost surfaces.

Once the construction of the bumper installation 30 has been completed, the bumper can be installed on a sensor gate 100 in the manner illustrated in FIGS. 7 and 8. As shown therein, the bumper installation 30 is installed on the sensor gate 100 by sliding the bumper installation over the sensor gate such that the sensor gate is positioned within the cushion cavity. For the bumper installation of the preferred embodiment, the bumper is slid down towards a floor surface until the bottom edge 64 of the casing 36 contacts the floor surface and the bottom surface 66 of the cushion 32 is positioned above the top surface of the sensor gate's protruding base member 102.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A bumper for a sensor gate having an external configuration, the bumper comprising:

a cushion having a cavity formed therein, the cavity having a configuration complementary to the external configuration of the sensor gate enabling the bumper to be easily mounted on the sensor gate without tools by sliding the bumper over the sensor gate with the sensor gate positioned within the cavity; and a casing having an interior and a rigid exterior, the cushion being secured to the casing interior, wherein at least a portion of the casing extends below the cushion enabling the casing to contact a floor surface and the cushion to contact a base surface of the sensor gate when the bumper is mounted on the sensor gate.

2. A bumper for a sensor gate, comprising:

a cushion having a cavity formed therein, the cavity having a configuration complementary to an external configuration of a sensor gate enabling the bumper to be mounted on the sensor gate with the sensor gate positioned within the cavity;

a casing having an interior and a rigid exterior, the cushion being secured to the casing interior, the casing being formed from a single sheet of material having opposite abutting ends; and a second sheet of material attached to the casing interior where the opposite ends abut.

3. The bumper of claim 2, wherein the second sheet of material comprises a plastic.

4. The bumper of claim 2, wherein the cushion includes a plurality of cushion sections, one of the cushion sections being secured to the second sheet of material.

5. A method for making a bumper for protecting a sensor gate, comprising the steps of:

securing a cushion to a first sheet of material having opposite ends;

heating a portion of the first sheet of material;

folding the first sheet of material along the heated portion so that the opposite ends abut; and attaching a second sheet of material to an inner surface of the first sheet of material where the opposite ends abut.

6. The method of claim 5, further comprising the step of:

securing a cushion section to the second sheet of material.

7. A bumper for a sensor gate having an external configuration, the bumper comprising:

a cushion having a cavity formed therein, the cavity having a configuration complementary to the external configuration of the sensor gate enabling the bumper to be easily mounted on the sensor gate without tools by sliding the bumper over the sensor gate with the sensor gate positioned within the cavity, wherein the cushion is configured to continuously contact the sensor gate when mounted thereon.

8. The bumper of claim 1, wherein the cushion completely surrounds the cavity so that the bumper extends around the entirety of the sensor gate when mounted thereon.

9. The bumper of claim 1, further comprising:

a casing having an interior and a rigid exterior, the cushion being secured to the casing interior.

10. The bumper of claim 9, wherein the cushion includes a plurality of cushion sections and the casing includes a plurality of interconnected surfaces, each interconnected surface having one of the cushion sections attached thereto.

11. The bumper of claim 10, wherein each cushion section contacts at least two cushion sections adjacent thereto, the plurality of cushion sections completely surrounding the cavity so that the bumper extends around the entirety of the sensor gate when mounted thereon.

12. The bumper of claim 9, wherein the casing is formed from a material comprising a plastic.

13. The bumper of claim 9, wherein the casing is formed from a single sheet of material.

14. A method for making a bumper for protecting a sensor gate, comprising the steps of:

securing a cushion to a first sheet of material;

heating a portion of the first sheet of material with the cushion secured thereto; and folding the first sheet of material along the heated portion.

15. The method of claim 14, wherein the step of folding includes folding the first sheet of material into a generally rectangular configuration.

16. The method of claim 14, wherein the step of securing includes securing a plurality of cushion sections to the first sheet of material.

17. The method of claim 14, wherein the step of securing includes securing the cushion to the first sheet of material with at least a portion of the first sheet of material extending below the cushion.

18. The method of claim 14 wherein the step of folding includes folding the first sheet of material so that opposite ends of the first sheet of material abut.

19. A method for protecting a sensor gate with a bumper, the bumper including a cushion having a cavity formed therein, the method comprising the step of:

installing the bumper on the sensor gate with the sensor gate positioned within the cushion cavity, wherein the step of installing includes sliding the bumper over the sensor gate to thereby mount the bumper on the sensor gate without tools.

* * * * *